US008065745B2

(12) United States Patent
Huell

(10) Patent No.: US 8,065,745 B2
(45) Date of Patent: Nov. 29, 2011

(54) FUNEREAL GARMENT

(76) Inventor: Melvin Huell, Georgetown, SC (US)

( * ) Notice: Subject to any disclaimer, the term of this patent is extended or adjusted under 35 U.S.C. 154(b) by 44 days.

(21) Appl. No.: 12/492,217

(22) Filed: Jun. 26, 2009

(65) Prior Publication Data

US 2010/0325768 A1 Dec. 30, 2010

(51) Int. Cl.
*A41D 13/00* (2006.01)
*A41D 1/00* (2006.01)

(52) U.S. Cl. ..... 2/64; 2/DIG. 3; 2/455

(58) Field of Classification Search ..... 2/455, 459, 2/461–465, 467, 267, 268, 69, DIG. 3, 64; 450/38, 54–57
See application file for complete search history.

(56) References Cited

U.S. PATENT DOCUMENTS

| | | | | |
|---|---|---|---|---|
| 765,536 | A * | 7/1904 | Worden | 2/64 |
| 1,101,724 | A * | 6/1914 | Blackford | 2/64 |
| 3,097,361 | A * | 7/1963 | Bourgraf | 2/64 |
| 3,777,310 | A | 12/1973 | Yang | |
| 4,031,565 | A | 6/1977 | Coates | |
| 4,166,471 | A | 9/1979 | Griffin et al. | |
| 4,310,927 | A * | 1/1982 | DeBose | 2/115 |
| 4,441,211 | A * | 4/1984 | Donzis | 2/459 |
| 4,699,144 | A * | 10/1987 | Sherwood | 450/54 |
| 4,781,650 | A | 11/1988 | Budd | |
| 4,834,688 | A | 5/1989 | Jones | |
| 5,395,280 | A | 3/1995 | Greenburg | |
| 5,758,363 | A * | 6/1998 | Winfree | 2/122 |
| 5,983,394 | A * | 11/1999 | Joo | 2/113 |
| 6,302,760 | B1 * | 10/2001 | Dai | 450/38 |

FOREIGN PATENT DOCUMENTS

| | | |
|---|---|---|
| JP | 05-111517 A | 5/1993 |
| JP | 2000-110008 A | 4/2000 |

* cited by examiner

*Primary Examiner* — Gloria Hale
(74) *Attorney, Agent, or Firm* — Steven J. Hultquist; Hultquist IP

(57) ABSTRACT

A funereal garment for use in providing a full and healthy appearance to a corpse lacking tissue necessary for such appearance. The garment includes a main garment body with compartments positioned to receive shaped inserts, wherein the compartments and shaped inserts are provided in sufficient number and location to provide a supplementary mass and enhanced physiological conformation to a corpse dressed in such garment, simulative of a full and healthy appearance of the corpse in relation to the corpse without such garment. The inserts may be inflatable articles or forms of predetermined shape, adapted for placement and retention in the compartments of the garment, so that the funereal garment provides the corpse with an aesthetic appearance for viewing and funeral/internment ceremonies.

10 Claims, 4 Drawing Sheets

11
12
50
51
10

FUNEREAL GARMENT

BACKGROUND OF THE INVENTION

1. Field of the Invention

The present invention relates to garments or clothing articles for dressing a deceased person for presentation at a funeral or burial service, a wake, or viewing of the corpse prior to burial, interment, cremation, or other final disposition of the body. The invention in one implementation relates to a funereal garment that is adapted to be worn by a decedent whose body at the time of death lacks significant tissue in relation to normal body conformation, such as may have resulted from a wasting illness or traumatic injury.

2. Description of the State of the Art

In contemporary society, many social practices and religions involve ceremonies following the death of an individual, in which the body of the decedent is presented during such ceremonies, and/or before and/or after they take place. For example, such traditions may include display of a body of the deceased for a period of time accommodating viewing by friends, family members and others who wish to pay respects or provide solace to survivors of the decedent. Some traditions involve a watch or vigil that is held over the body of the deceased prior to burial or cremation.

In many instances, the appearance of the body of the deceased has become substantially deteriorated in the period preceding death, as a result of disease, accident, or physiological decline involving loss of tissue, wasting, emaciation or other condition in which the body mass is significantly lessened, in relation to a prior full and healthy appearance of such individual. Under these circumstances, undertakers, embalmers and funeral directors generally strive to prepare the corpse so that such prior full and healthy appearance of the body is simulated. These efforts are rendered disproportionately more difficult when the loss of body mass is substantial in amount. If not able to be restored to a full and healthy appearance, the corpse of the decedent in an eviscerated condition may occasion shock and additional grief to mourners viewing the body, particularly those whose last memories and visual recollection of the decedent involved such a full and healthy appearance.

SUMMARY OF THE INVENTION

The present invention relates to a funereal garment for use in providing a full and healthy appearance to a corpse lacking tissue necessary for such appearance.

The funereal garment of the invention is adapted to be worn on the corpse of a deceased person after appropriate placement of inserts in garment compartments and subsequent dressing of the corpse, whereupon the garment effectively disguises missing tissue of the deceased.

In one aspect, the invention relates to a funereal garment comprising a main garment body including compartments adapted to receive shaped inserts or inflation fluid, wherein the compartments are provided in sufficient number and location to provide a supplementary mass and enhanced physiological conformation to a corpse dressed in such garment when at least some of said compartments hold the shaped inserts or inflation fluid, in relation to the corpse in the absence of said garment.

In another aspect, the invention relates to a garment adapted to be worn on the body of a deceased person with tissue loss, said garment comprising a clothing article containing compartments positioned to overlie body locations corresponding to missing tissue of the deceased person, wherein said compartments are each adapted to hold one or more inserts each of which is modifiable so that each said compartment holding said one or more inserts corresponds to volume of the missing tissue at a corresponding overlaid body location.

In a further aspect, the invention relates to a funereal garment comprising a clothing article that includes compartments that are modifiable in shape and are positioned to overlie body regions including at least one of (i) and (ii):

(i) pectoral, abdominus, oblique, deltoid, and bicep regions; and (ii) gluteal, quadriceps, vastus, gastrocnemius, and tibialis regions.

In another aspect, the invention relates to a funereal garment that includes a front panel, back panels, and arm panels sewn together to form an upper body clothing article having a neck opening, sleeves with arm and hand openings, a waist opening, and a back opening between side edges of the back panels running from the neck opening to the waist opening, wherein the garment has at least one fastener for closing the back opening, said clothing article including compartments that are positioned to overlie body locations corresponding to missing tissue of a deceased person, and wherein each of the compartments is adapted to hold one or more insert articles that are selectively modifiable to correspond to a volume of missing tissue when disposed in a said compartment, to simulate the appearance of missing tissue when the deceased person is dressed in said garment.

A further aspect of the invention relates to a method of preparing a body mass-deficient corpse for viewing or other final ceremonies, comprising dressing the corpse in a funereal garment including garment compartments that are fillable with shaped inserts or with an inflation fluid, and filling the compartments with said shaped inserts or inflation fluid, to simulate absent body mass of the corpse.

Other aspects, features and embodiments of the invention will be more fully apparent from the ensuing disclosure and appended claims.

DETAILED DESCRIPTION OF THE INVENTION, AND PREFERRED EMBODIMENTS THEREOF

Figure 1:
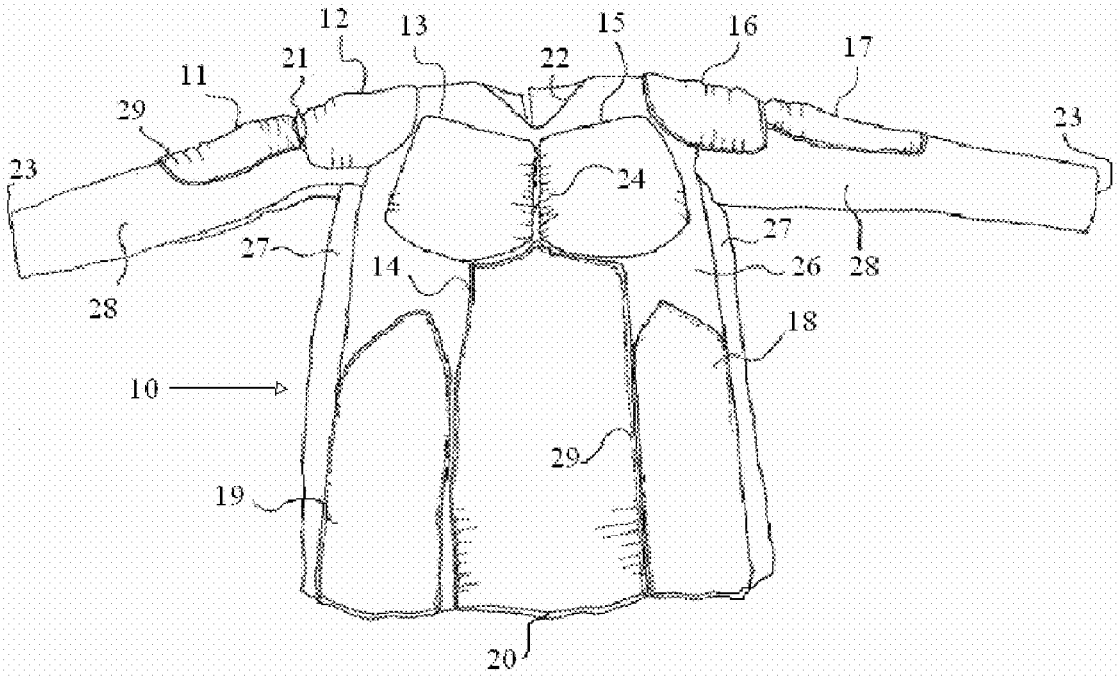
FIG. 1 is a front view of an upper body embodiment of the funereal garment according to one aspect of the present invention.

The present invention relates to a funereal garment that is adapted to be worn by a decedent whose body at the time of death lacks significant tissue in relation to normal body conformation, such as may have resulted from a wasting illness or traumatic injury.

The funereal garment of the invention is adapted to provide a full and healthy corporeal appearance to a corpse lacking tissue necessary for such full and healthy appearance.

The invention in one aspect relates to a funereal garment comprising a main garment body including compartments adapted to receive shaped inserts or inflation fluid, wherein the compartments are provided in sufficient number and location to provide a supplementary mass and enhanced physiological conformation to a corpse dressed in such garment when at least some of said compartments hold the shaped inserts or inflation fluid, in relation to the corpse in the absence of said garment.

The compartments in one embodiment are adapted to receive shaped inserts. Alternatively, the compartments can be adapted to receive inflation fluid.

The funereal garment may be provided as a kit assembly including the main garment body and the shaped inserts, so that the funereal garment can be configured with at least some of the shaped inserts disposed in at least some of the compartments, as adapted to and disposed on a specific corpse.

Each of the shaped inserts of the garment can be fabricated to be inflatable with an inflation fluid, e.g., air, helium, water, or other fluid. For such purpose, each of such shaped inserts can include an inflation valve adapted for selectively inflating and deflating the insert.

The funereal garment may be constructed with the main garment body including a front panel, back panels, and arm panels sewn together to form an upper body clothing article having a neck opening, sleeves with arm and hand openings, a waist opening, and a back opening between side edges of the back panels running from the neck opening to the waist opening, with the garment having at least one fastener for closing the back opening.

The garment may be fabricated so that the compartments are positioned to overlie body regions including at least one of (i) and (ii):

(i) pectoral, abdominus, oblique, deltoid, and bicep regions; and (ii) gluteal, quadriceps, vastus, gastrocnemius, and tibialis regions.

The invention in a further aspect relates to a garment adapted to be worn on the body of a deceased person with tissue loss, such garment comprising a clothing article containing compartments positioned to overlie body locations corresponding to missing tissue of the deceased person. The compartments are each adapted to hold one or more inserts each of which is modifiable so that each such compartment holding one or more inserts corresponds to volume of the missing tissue at a corresponding overlaid body location.

The compartments may for example be configured to overlie shoulder, arm, chest, and abdominal areas of the body of the deceased person.

The garment itself may be constituted with the clothing article including a front panel, back panels, and arm panels sewn together to form an upper body clothing article having a neck opening, sleeves with arm and hand openings, a waist opening, and a back opening between side edges of the back panels running from the neck opening to the waist opening, wherein the garment has at least one fastener for closing the back opening.

The funereal garment invention in another embodiment is configured as a clothing article that includes compartments that are modifiable in shape and are positioned to overlie body regions including at least one of (i) and (ii): (i) pectoral, abdominus, oblique, deltoid, and bicep regions; and (ii) gluteal, quadriceps, vastus, gastrocnemius, and tibialis regions.

In another embodiment, the invention relates to a funereal garment that includes a front panel, back panels, and arm panels sewn together to form an upper body clothing article having a neck opening, sleeves with arm and hand openings, a waist opening, and a back opening between side edges of the back panels running from the neck opening to the waist opening. The garment has at least one fastener for closing the back opening, and the clothing article includes compartments that are positioned to overlie body locations corresponding to missing tissue of a deceased person. Each of the compartments is adapted to hold one or more insert articles that are selectively modifiable to correspond to a volume of missing tissue when disposed in such compartment, to simulate the appearance of missing tissue when the deceased person is dressed in the garment.

The compartments in such funereal garment may be positioned to overlie body regions including at least one of (i) and (ii): (i) pectoral, abdominus, oblique, deltoid, and bicep regions; and (ii) gluteal, quadriceps, vastus, gastrocnemius, and tibialis regions.

The invention in another aspect relates to a method of preparing a body mass-deficient corpse for viewing or other final ceremonies. The method comprises dressing the corpse in a funereal garment including garment compartments that are fillable with shaped inserts or with an inflation fluid, and filling the compartments with the shaped inserts or inflation fluid, to simulate absent body mass of the corpse.

The invention thus provides a funereal garment that is adapted to be worn on the body of a deceased person with missing or insufficient amount of tissue, for presentation of the body with an apparent mass and appearance simulative of presence of such tissue, e.g., in connection with a funeral, wake, burial or other internment ceremony. The funereal garment is constructed to simulate the appearance of a full-bodied and healthy individual when worn on the body of a deceased individual having significant tissue loss from one or more areas of the body, in relation to a full-bodied and healthy appearance of such individual.

The funereal garment compartments in one embodiment of the invention are positioned to overlie locations on the corpse of the decedent corresponding to the major musculature areas of the human body and/or various selected tissue areas of the human body. The compartments are each adapted to hold one or more inserts that are modifiable to correspond to a selected volume of missing musculature or tissue for a particular individual at that physiological location. By placing an insert or inserts in each of several compartments, depending on the extent of the tissue missing from the body of the deceased, and based on the corporeal girth and appearance of the deceased individual while still living, the garment simulates the appearance of missing tissue when worn underneath a covering or a layer of outer clothing. In one specific embodiment, the funereal garment includes an outer clothing article that is attached to or integrally formed with an inner clothing article that includes the compartments and inserts as described herein.

The features and advantages of the invention are further illustrated with reference to the embodiments shown and described in connection with FIGS. 1-4, and as more fully described hereinafter.

As shown in FIG. 1, the funereal garment includes an upper body clothing article 10 adapted to allow one or more inserts to be placed in compartments 11-19 positioned at locations on the abdomen, chest and arm areas of the clothing article 10 in order to simulate missing tissue in those areas. As further depicted in FIG. 1, compartments 13 and 15 are positioned on the chest area of the clothing article to correspond to the general location of the pectoral muscles on the body of a wearer. Compartments 11 and 17 are positioned on the right and left upper arm area corresponding to the general location of the biceps muscles, while compartments 12 and 16 are positioned on the right and left shoulder and upper back areas, corresponding to the deltoid and trapezius muscles located in these body areas. Compartment 14 is positioned in a central region of the clothing article 10, traversing clothing article 10 longitudinally from just below the chest area to the waist area, so that such compartment is positioned on the abdominal area of the body corresponding to the location of the abdominal muscles and associated abdominal tissue of the corpse. Compartments 18 and 19 are positioned to the right and left side of compartment 14, corresponding to the right side and left side of the body of the wearer.

Figure 2:
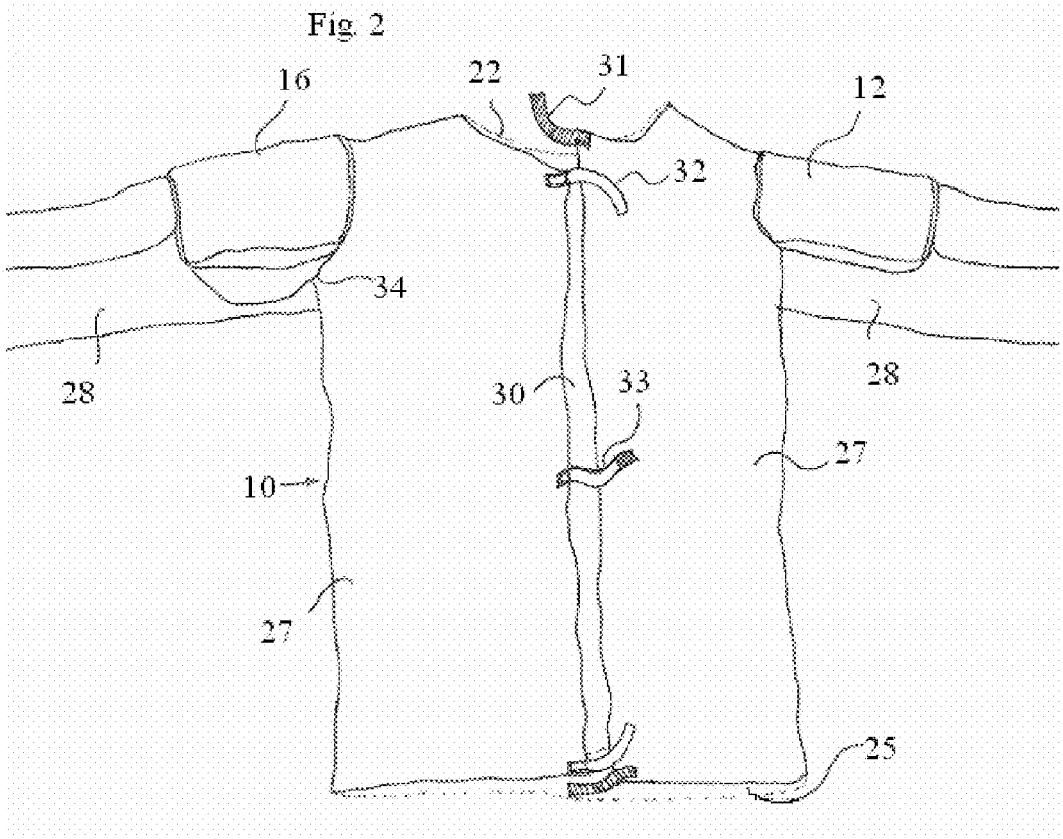
FIG. 2 is a rear view of the funereal garment of FIG. 1.

In the funereal garment shown in FIGS. 1 and 2, the upper body clothing article 10 can be assembled by sewing, to join respective pieces of material in the shape of front panel 26, two side/back panels 27, and arm panels 28. Clothing article 10 includes front panel 26 joined to right and left side/back panels 27 along respective side edges of the front panel, to form a layer of material covering the chest, abdomen, sides, and back of the wearer, with a neck opening 22 and waist opening 25, as depicted in FIGS. 1 and 2. Front panel 26 and side/back panels 27 are further joined to the top edge of right and left arm panels 28 to form the sleeves 23 with arm and hand openings, as depicted in FIGS. 1 and 2.

The assembled panels represented by numerals 26, 27, and 28 are joined together at their respective edges form the underlying jacket-like article to which compartments 11-19 are attached. The assembled clothing article 10 includes neck opening 22, sleeves 23 with arm/hand openings, a waist opening 25, and a rear opening 30.

In one embodiment of the funereal garment, the material used for the clothing article 10 is a stretchable fabric such as nylon, but the material may be any natural, synthetic or composite fabric or other material suitable for constructing the clothing article 10 of the invention. Although the embodiment described herein and shown in FIGS. 1 and 2 depicts the fabric or material panels of clothing article 10 as being joined together by stitching, i.e., having been sewn to one another at their respective edges, the fabric or material panels may be joined to one another by any manner known to those of skill in the art of garment manufacture.

Thus, the funereal garment may in particular embodiments be assembled by sewing together pieces of fabric or material panels of specific shapes to form a clothing article 10 of the type depicted in FIGS. 1 and 2, the clothing article 10 may alternatively be assembled using adhesive bonding of fabric or other material panels to form the clothing article, thermoforming of panels of thermoplastic material to suitable shapes, mandrel forming of the garment or selected portions thereof using nonwoven web-forming techniques, or any other suitable techniques and/or materials now or hereafter known in the art of garment manufacture. The invention specifically contemplates funereal garments formed as composite as well as unitary structures.

In the funereal garment depicted in FIGS. 1 and 2, the upper body clothing article 10 includes compartments 11-19 that are assembled by attaching an additional layer or layers of material of suitable shapes to the underlying fabric panel to create a pocket for holding an insert overlying the appropriate location on the body of the wearer. It is noted that the shapes of the compartments 11-19 are not limited to the shapes depicted in FIGS. 1 and 2, but may be of any shapes that are suitable for holding inserts overlying the appropriate location on the body of the wearer.

In one embodiment of the funereal garment, the material used for the compartments 11-19 is a stretchable fabric such as nylon, but the material may be any fabric or material suitable for constructing such compartments 11-19. The material may be stretchable and resiliently elastic in character, to accommodate inserts of variable size, or the compartments may be formed with pleated or gusseted pocket constructions for such purpose.

Referring again to FIGS. 1 and 2, compartments 11 and 14 include stitching 29 around the periphery of three sides of the compartment attaching the fabric of the compartment to the underlying fabric layer and creating a receptacle for holding the inserts used to simulate missing tissue.

As depicted in FIG. 1 for compartment 14, the stitching 29 does not extend across the bottom of the compartment 14, thereby forming an opening 20 that allows the insert or inserts to be placed into the compartment 14 in an appropriate position to simulate tissue missing from the associated area of the body of the wearer. As shown in FIG. 1 for compartment 11, the position of the opening 21 of the compartment can be altered by changing the side of the compartment containing the stitching 29 extending along the periphery of the compartment. It is noted that while compartments 11-19 are attached to the underlying fabric layer by stitching or sewing, any suitable structure and media for affixing one layer of material to another may be used to form the compartments that hold the inserts overlying the appropriate corporeal regions of the body of the wearer.

FIG. 1 also illustrates the size variability of the compartments 11-19 associated with the structure of the compartments. The right chest area compartment 15 of the clothing article 10 includes fabric folds 20, whereby the compartment is constructed to expand to accommodate multiple inserts or inserts of varying sizes depending on the volume of tissue loss in that area of the body that is necessary to replicate the full-bodied appearance of the deceased individual.

Referring to FIG. 2, depicting an embodiment of the funereal garment showing the rear view of the upper body clothing article 10, fastener assemblies 31-33 and rear opening 30 are displayed. Fastener assemblies 31 and 32 are shown in the open position, while the fastener assembly 33 is depicted in a fastened or closed configuration. In one embodiment of the clothing article 10, the fastening assemblies include strips of the fastening tape Velcro™, but the fastening assemblies alternatively may include buttons, snaps, zippers, or any suitable number and construction of complementary fastener elements for closing the back opening of the funereal garment or otherwise securing the garment in position on the body of a corpse.

Figure 3A:
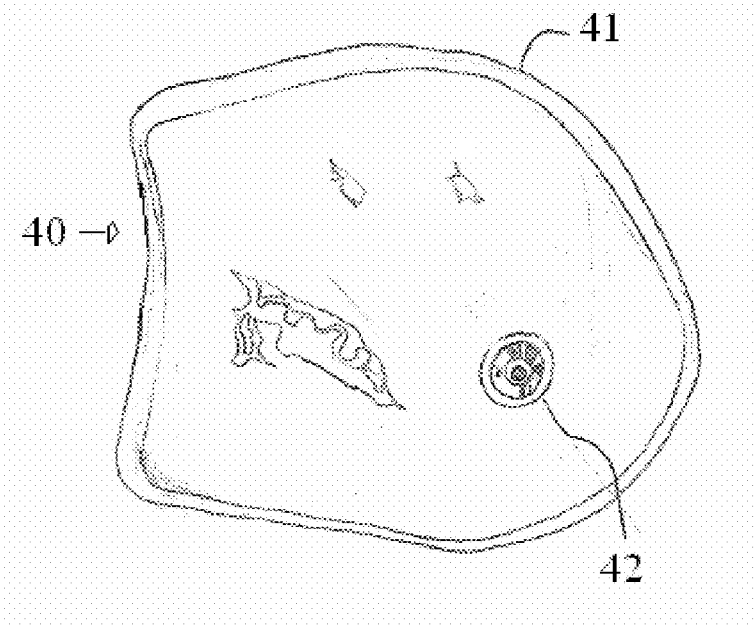
FIG. 3A is a top view of one embodiment of an inflatable insert that may be utilized in the funereal garment of the present invention.
Figure 3B:
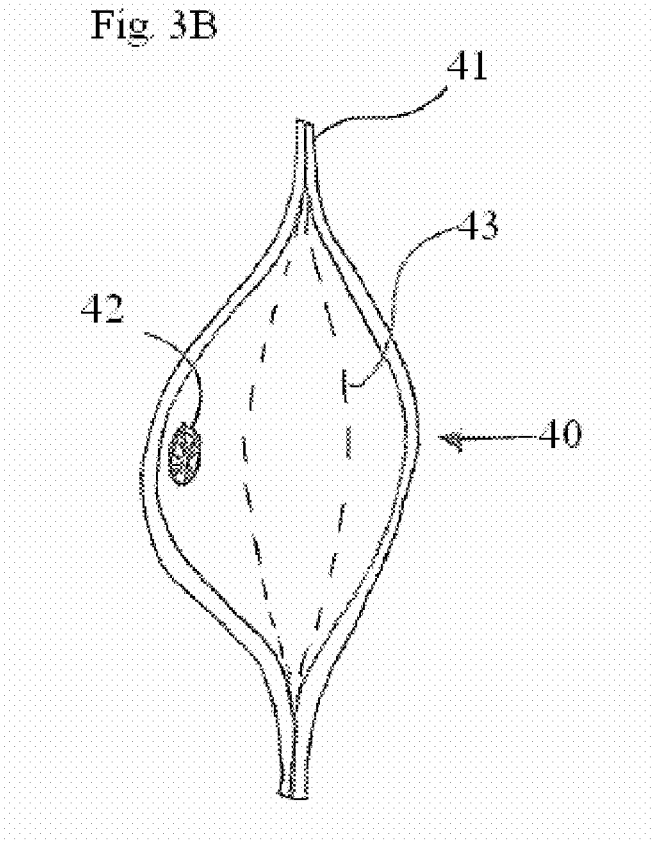
FIG. 3B is a cross-sectional view of the inflatable insert of FIG. 3A.

FIGS. 3A and 3B depict a top view and a cross-sectional view of an embodiment of the insert for use in compartments 11-19 to simulate the volume of missing tissue from the body of the deceased individual. As shown in FIGS. 3A and 3B, insert 40 includes first and second layers of material disposed adjacent to one another and bonded at their periphery 42 to create an interior volume. The interior volume can be filled with air or other suitable fluid. In one embodiment, the layers of material used to construct insert 40 are plastic, e.g., polyethylene, polypropylene, polyurethane, etc., but in general such layers can comprise any fluid-impermeable material that is effective to maintain the volume and desired shape of the insert for simulation of a normal size and conformation of the missing tissue of the corpse to which the garment containing such inserts is applied.

As also shown in FIGS. 3A and 3B, insert 40 includes an inflation element 42, which can be used to selectively inflate or deflate the insert to an appropriate size to simulate the appearance of the missing tissue from the corpse of the deceased individual. FIG. 3B further depicts a cross-sectional view of one embodiment of an inflatable insert, showing inflation element 42, with the dashed line 43 representing the layers of the correspondingly uninflated insert. In one embodiment of the insert, inflation element 42 comprises an air valve, but in general the inflation element can include any structure or components effective to selectively inflate and deflate the insert for use in a compartment to simulate the appearance of the missing tissue of the corpse on which the garment containing the inserts is disposed.

Although the inserts have been illustrated and described as being formed by superimposed sheets of suitable material that are bonded to one another at their respective margins, it will be appreciated that inserts useful in the broad practice the present invention may be of varying types. For example, the insert may be fabricated as a unitary structure, such as a polymeric envelope formed by extrusion blow molding of a suitable extrusion molding plastic, having an inflation port integrally formed in the envelope structure or otherwise adapted to be selectively inflated, and deflated, to appropriate size for simulating the missing tissue of the corpse in a specific compartment of the garment.

Alternatively, the garment may be fabricated to accommodate insertion into a compartment of specific ones of multiple inserts, each of a different size, to accommodate various body types, e.g., endomorphic, mesomorphic and ectomorphic physiologies. For such purpose, the inserts may each be fabricated as leak-tight container holding a fluid, solid, semisolid or other material medium, imparting a desired shape to the insert. The inserts may for example comprise flexible bag-type containers holding gel or foam material. The inserts may also be solid bodies having a predetermined shape simulative of the non-eviscerated or otherwise absent tissue of the corpse. It will be appreciated that the inserts may be of widely varied types, as appropriate or desirable for a given application of the invention.

Figure 4:
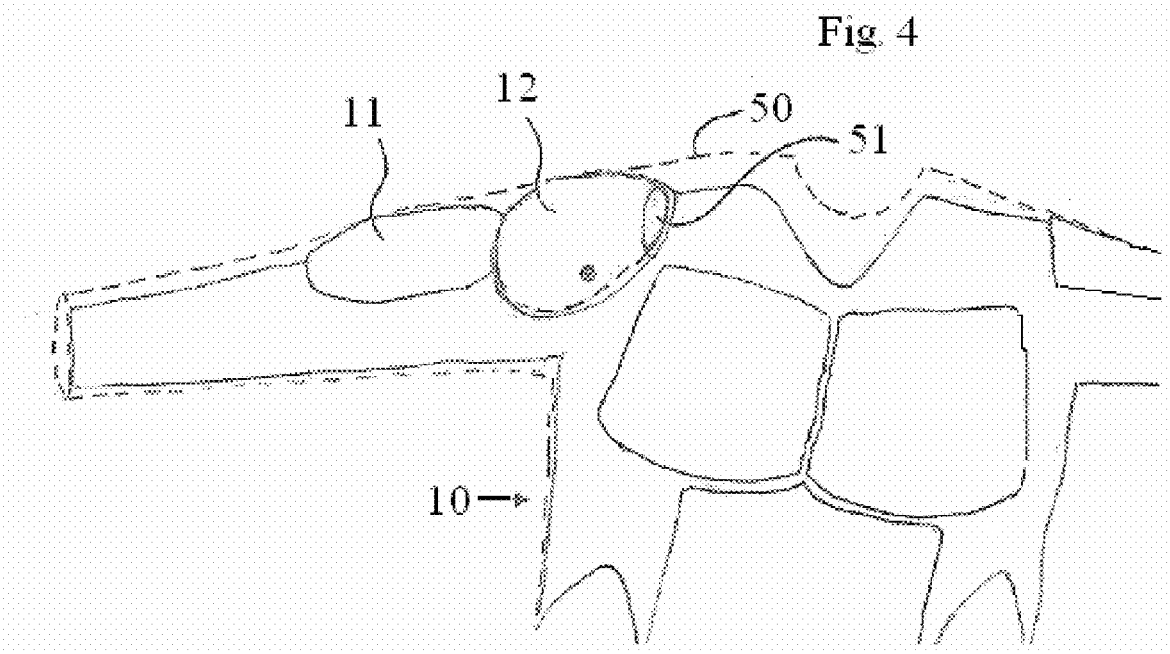
FIG. 4 is a view of a funereal garment of the type shown in FIG. 1, with an inflatable insert positioned in a compartment in the right shoulder area of the garment.

FIG. 4 depicts an embodiment of the funereal garment showing the upper body clothing article 10 with an inflated insert 51 in compartment 12, overlying the shoulder and upper back area of the body of a wearer of the garment. As shown in such clothing article 10, the inflated insert 51, when covered with outer clothing or another layer of material as represented by dashed line 50, presents the appearance of tissue that is in fact missing from the shoulder and upper back area of the body of the deceased individual.

The funereal garment of the present invention is modifiable and adaptable to simulate various missing or inadequate upper body tissue regions, depending on the number and size of the inflatable inserts that are used in the appropriate compartment(s) of the clothing article 10. Following appropriate placement of the inflated inserts in the garment, installation of the garment on the body of a corpse, and covering the garment with outer clothing, the garment effectively disguises missing tissue of the deceased individual.

It is to be appreciated that while the embodiments of the funereal garment described herein and depicted in FIGS. 1-4 are directed to a clothing article 10 for use on the upper body of a deceased individual, the funereal garment can alternatively be constituted by a lower body clothing article, or such garment can be fabricated as a full body garment, with compartments accommodating inserts that permit a full-bodied conformation of the corpse to be achieved. A lower body clothing article in accordance with the invention is adapted to cover the lower body of the deceased person, including the hips, pelvis, and leg areas of the body of such individual, with compartments positioned to overlie tissue of the lower abdomen and pelvis, hips, and legs, including the positions of the gluteal, quadriceps, vastus, gastrocnemius, and tibialis muscles.

The funereal garment of the invention can therefore be constituted as an upper body garment, a lower body garment, an assembly of upper and lower body garments that may be separate and distinct from one another, or that may be interconnectable or attachable to one another, or the garment may comprise a full body garment of unitary character, e.g., constituted in the form of a jumpsuit, bodystocking, or other apparel item providing a requisite filled-out appearance to the corpse. The garment, in embodiments in which the inserts are of an inflatable character, may be fabricated with an inflation pump, e.g., of a syringe type, integrally associated with the garment such as by mounting thereon at a location that will not be visible when the corpse is fully dressed.

The garment of the invention yet another embodiment can be fabricated with compartments that are leaktight in character and are directly inflatable, rather than utilizing insert components. For such purpose, the compartments can be fabricated with inflation fluid supply lines in the garment, communicating with the compartments and a central fluid introduction port, whereby a pressurized fluid can be introduced at the central port have flowed to the respective compartments in the garment, to provide a non-eviscerated appearance to the corpse on which the garment is disposed.

The garment of the invention may in specific embodiments be fabricated initially with inserts contained in sewn-closed pockets, as a ready-to-wear article that can be applied to the body of the corpse without any selective modification or adaptation to a specific individual, it generally is desirable to provide the basic garment with open pockets and a complement of variably sized insert articles, to accommodate the wide variety of body types and conditions encountered in practice, so that the undertaker, embalmer or funeral director responsible for the preparation of the body of the deceased can selectively shape the body to a desired aesthetic appearance by selection and installation on the garment of specific ones of multiple possible inserts.

Accordingly, the garment of the invention may be provided in a kit including multiple insert articles of varied size and shape characteristics for use with the garment, or alternatively in a kit including a plurality of garments of varying size, together with a plurality of insert articles that may be used with various garments in the collection.

Although the garment of the invention in various embodiments thereof is contemplated for use as an undergarment that can be used to shape the body of the corpse to a full-filled conformation, prior to dressing the corpse in conventional outer garment apparel, it will be appreciated that the garment can alternatively be fabricated as an outer garment apparel item, e.g., as a dress, shirt, skirt, trousers, sport coat, suit jacket, or the like, in which the compartments are interior to the apparel item.

The invention therefore contemplates a method of preparing a body mass-deficient corpse for viewing or other final ceremonies, utilizing a funereal garment of the invention, in which compartments of the garment are filled, by shaped inserts or inflation of leaktight pockets, to simulate missing body mass of the corpse.

While the invention has been has been described herein in reference to specific aspects, features and illustrative embodiments of the invention, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Correspondingly, the invention as hereinafter claimed is intended to be broadly construed and interpreted, as including all such variations, modifications and alternative embodiments, within its spirit and scope.

What is claimed is:

1. A funereal garment assembly, comprising:

a garment including pectoral, abdominus, oblique, deltoid, and bicep region compartments adapted to overlie and shaped to cover respective pectoral, abdominus, oblique, deltoid, and bicep regions of a corpse when dressed in said garment, each of said compartments including an opening enabling the compartment to receive a correspondingly shaped inflatable insert; and a set comprising correspondingly shaped inflatable inserts for each of said pectoral, abdominus, oblique, deltoid, and bicep region compartments of the garment, wherein the garment is configurable with one or more of said pectoral, abdominus, oblique, deltoid, and bicep region compartments of the garment holding an inflated correspondingly shaped insert from said set, to thereby provide an appearance of enhanced physiological conformation to a corpse dressed in such garment, in relation to the corpse in the absence of said garment.

2. The funereal garment assembly of claim 1, wherein the compartments comprise a stretchable and resiliently elastic fabric.

3. The funereal garment assembly of claim 1, wherein the garment comprises a garment body, and the compartments comprise one or more layers of material attached to the garment body to create a pocket for the correspondingly shaped insert from said set.

4. The funereal garment assembly of claim 1, further comprising an inflation pump adapted to inflate the shaped inflatable inserts in said set.

5. The funereal garment assembly of claim 1, arranged for use on the body of a corpse.

6. The funereal garment assembly of claim 1, wherein each of the shaped inflatable inserts comprises superimposed sheets of polymeric material bonded to one another at respective margins thereof.

7. The funereal garment assembly of claim 6, wherein each of the shaped inserts includes an inflation valve adapted for selectively inflating and deflating the insert.

8. The funereal garment assembly of claim 1, wherein the garment includes a front panel, back panels, and arm panels sewn together to form an upper body clothing article having a neck opening, sleeves with arm and hand openings, a waist opening, and a back opening between side edges of the back panels running from the neck opening to the waist opening, wherein the garment has at least one fastener for closing the back opening.

9. The funereal garment assembly of claim 1, wherein the garment is configured as a jacket article with a back opening having facing edges extending between a neck opening and a waist opening of said jacket article.

10. A method of preparing a body mass-deficient corpse for viewing or other final ceremonies, comprising dressing the corpse in a funereal garment as claimed in claimed 1, with one or more of said pectoral, abdominus, oblique, deltoid, and bicep region compartments of the garment holding an inflated correspondingly shaped insert from said set.

* * * * *